US006337687B1

(12) United States Patent
Lee

(10) Patent No.: US 6,337,687 B1
(45) Date of Patent: Jan. 8, 2002

(54) APPARATUS FOR CONTROLLING VIDEO MODE OF COMPUTER HAVING LCD AND METHOD THEREFOR

(75) Inventor: Kyoung-won Lee, Busan (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/309,281

(22) Filed: May 11, 1999

(30) Foreign Application Priority Data

Jun. 11, 1998 (KR) ..... 98-21755

(51) Int. Cl.[7] ..... G09G 5/00

(52) U.S. Cl. ..... 345/472; 345/212; 345/660; 348/632; 348/633; 348/634

(58) Field of Search ..... 345/472, 212; 348/632, 633, 634

(56) References Cited

U.S. PATENT DOCUMENTS 5,313,225 A * 5/1994 Miyadera
5,534,889 A * 7/1996 Reents et al. ..... 345/132
5,751,261 A * 5/1998 Zavracky et al. ..... 345/55
5,784,037 A * 7/1998 Inoue ..... 345/87
5,790,096 A * 8/1998 Hill, Jr.
5,872,515 A * 2/1999 Ha et al. ..... 340/571
5,974,558 A * 10/1999 Cortopassi et al. ..... 713/323

* cited by examiner

*Primary Examiner*—Richard Hjerpe
*Assistant Examiner*—Jean Lesperance
(74) *Attorney, Agent, or Firm*—Robert E. Bushnell, Esq.

(57) ABSTRACT

A video mode controlling apparatus and method of a computer having a LCD is provided. The method includes the steps of checking whether or not the video mode to be changed by the mode change controlling information is supported by the video controller, turning the LCD off, changing font and video mode state of the video controller so as to correspond to the mode change controlling information, and turning the LCD on. It is possible to prevent the generation of a whitening phenomenon of a LCD which is liable to occur when the video mode is changed in a computer having the LCD.

16 Claims, 3 Drawing Sheets

APPARATUS FOR CONTROLLING VIDEO MODE OF COMPUTER HAVING LCD AND METHOD THEREFOR

CLAIM OF PRIORITY

This application makes reference to, incorporates the same herein, and claims all benefits accruing under 35 U.S.C §119 from an application for APPARATUS FOR CONTROLLING VIDEO MODE OF COMPUTER HAVING LCD AND METHOD THEREFOR earlier filed in the Korean Industrial Property Office on the $11^{th}$ of Jun. 1998 and there duly assigned Serial No. 21755/1998.

BACKGROUND OF THE INVENTION

1. Field of the Invention

The present invention relates to a computer having a liquid crystal display (LCD), and more particularly, to an apparatus for controlling a video mode of a computer having a LCD, and a method therefor.

2. Description of the Related Art

A video controller of an IBM® compatible personal computer currently in wide use supports video modes of various resolution levels and colors. The better the performance of a video controller and the monitor, the more of the various video modes are supported.

When a video mode having different resolution levels and colors of different precision levels is required by an application program operated in a personal computer, the video mode must sometimes be changed while the personal computer operates. Generally, to change the video mode of an application program, assistance of a video service routine Interrupt 10 h of a BIOS (Basic Input/Output System) is necessary. Then, in the case when the video mode to be changed into, that is, the requested video mode, is supported by a video controller installed in a personal computer, the video service routine changes existing fonts and mode state into fonts and a mode state of the changed (requested) video mode. Then, a video memory is accessed in accordance with the changed video mode, and video data read from the video memory is transferred to a display in accordance with the changed video mode.

Conventionally, the video mode is changed with the computer in a state where the display is not turned off. However, in the case of a certain display, particularly a liquid crystal display (LCD), a whitening phenomenon in which edges of the display are changed to be white occurs when a low resolution video mode is changed into a high resolution video mode while the display is on. This phenomenon may damage the display.

Examples from the conventional art of inventions dealing with video mode change in computers with liquid crystal display screens are seen in the following U.S. Patents. U.S. Pat. No. 5,534,889, to Reents et al., entitled Circuit For Controlling Bias Voltage Used To Regulate Contrast In A Display Panel, deals with the change in contrast perceived by the user as the output modes are changed. The invention controls the contrast through the use of a pulse width modulation circuit contained in the video controller, and the pulse width modulated signal is converted to a DC bias contrast voltage. This invention does not deal, however, with the whitening problem which occurs at the time of mode switching.

U.S. Pat. No. 5,790,096, to Hill, Jr., entitled Automiated Flat Panel Display Control System For Accomodating Broad Range Of Video Types And Formats, describes an electronics control system for flat panel displays which accommodates video signals of numerous types and formats. As a power saving feature, the system turns the power to the display off when the video signal is interrupted. However, this invention also does not deal with the whitening problem which occurs when video modes are switched.

U.S. Pat. No. 5,313,225, to Miyadera, entitled Liquid Crystal Display) Device, describes a device in which the back light of the liquid crystal display device is turned off after a predetermined time in which the video signal is not received for the purpose of power conservation. As with the above patents, this patent also does not deal with the whitening problem which occurs when video modes are switched.

Based on my observation of the art, then, I have determined that what is needed is an improved computer having a liquid crystal display in which the whitening phenomenon is avoided when the video mode is changed.

SUMMARY OF THE INVENTION

It is therefore an object of the present invention to provide an improved computer having a liquid crystal display.

It is also an object of the present invention to provide a improved method and apparatus for switching video modes in a computer having a liquid crystal display.

It is a further object of the present invention to provide a method and apparatus for switching video modes which avoids edge-whitening during the video mode change.

It is an additional object of the present invention to provide a method and apparatus for switching video modes which avoids damage to the display during the video mode change.

To achieve the above objects, a first aspect of the present invention provides an apparatus for controlling a video mode of a computer having a LCD for eliminating a whitening phenomenon of the LCD occurring when the video mode is changed. A second aspect of the present invention provides a method for controlling a video mode of a computer having a LCD for eliminating a whitening phenomenon of the LCD occurring when the video mode is changed. A third aspect of the present invention provides a computer having a video BIOS (Basic Input/Output system) having a function of eliminating a whitening phenomenon of a LCD occurring when the video mode is changed.

Accordingly, there is provided a video mode controlling apparatus of a computer having a video controller for receiving mode change controlling information for requesting the change of a video mode, and a LCD, the apparatus including a video mode checking portion for checking whether or not the video mode to be changed by the mode change controlling information is supported by the video controller, a video mode changing portion for changing font and video mode state of the video controller so as to correspond to the mode change controlling information, and a LCD on/off switching portion for turning the LCD off if it is determined by the video mode checking portion that the video mode is supported by the video controller and then starting up the video mode changing portion, and turning the LCD on after the video mode is changed by the video mode changing portion.

Secondly, there is provided a video mode controlling method of a computer having a video controller for receiving mode change controlling information for requesting the change of a video mode, and a LCD, the method including the steps of checking whether or not the video mode to be changed by the mode change controlling information is supported by the video controller, turning the LCD off, changing font and video mode state of the video controller so as to correspond to the mode change controlling information, and turning the LCD on.

Thirdly, there is provided a personal computer having a random access memory (RAM) for storing a plurality of programs having application programs, an operation system and a BIOS, a video controller, a LCD controlled by the video controller, and a microprocessor for executing the plurality of programs, wherein the BIOS has a video BIOS module including code means for checking whether or not the video mode to be changed by the mode change controlling information for requesting the video mode to be changed is supported by the video controller, code means for turning the LCD off, code means for changing font and video mode state of the video controller so as to correspond to the mode change controlling information, and code means turning the LCD on.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
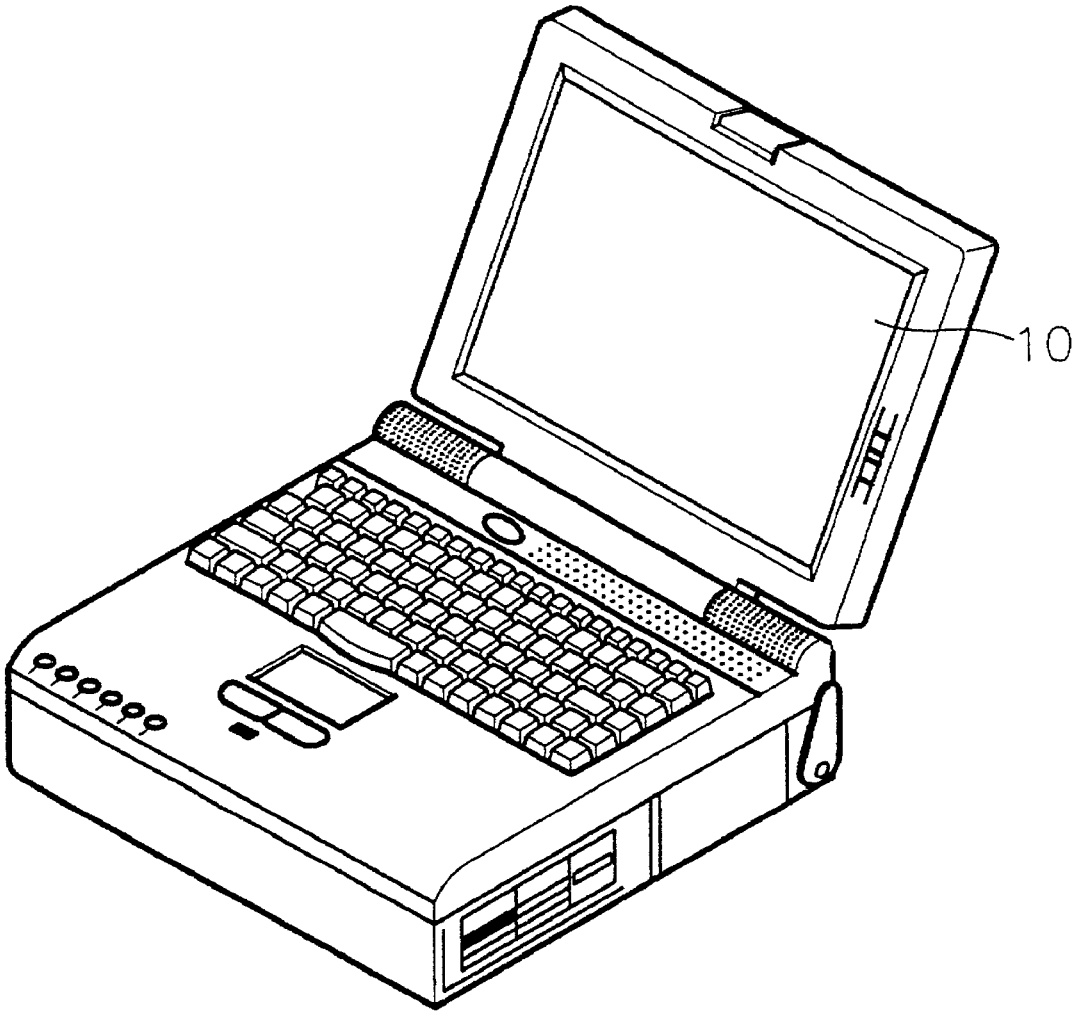
FIG. 1 illustrates the outer appearance of a computer of conventional design having a LCD.

Referring to FIG. 1, a small-sized computer of conventional design, e.g., a notebook computer, includes liquid crystal display 10 as its output device. A computer of the sort shown in FIG. 1 may be used to incorporate the present invention. Now, the present invention will be described in detail with reference to the accompanying drawings.

Figure 2:
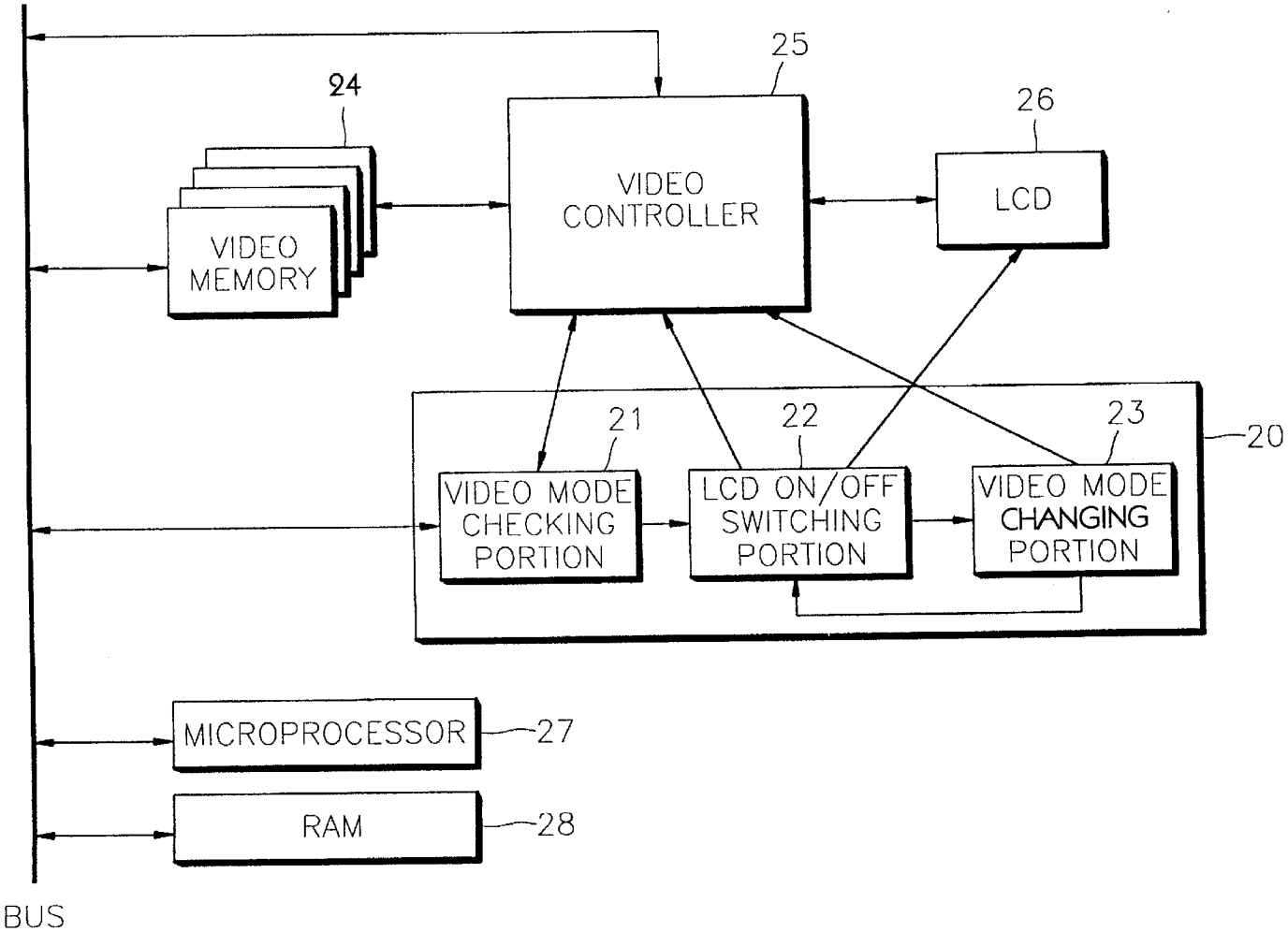
FIG. 2 is an internal schematic diagram illustrating a computer having a video mode controlling apparatus according to the present invention.

FIG. 2 is an internal schematic diagram illustrating a computer which has random access memory (RAM) 28 for storing a plurality of programs including application programs, an operation system and a BIOS, video controller 25, LCD 26 controlled by video controller 25, microprocessor 27 for executing the plurality of programs, and video mode controlling apparatus 20 according to the present invention. To display output information on LCD 26, the output information is stored in video memory 24 to be suitable for various video modes for supporting various resolution levels and colors. The information stored in video memory 24 is changed into a signal for being displayed by video controller 25 and the signal is transmitted to LCD 26.

The application programs of the computer in which LCD 26 is incorporated allow the video mode to be changed according to the characteristics of displayed data. As shown in FIG. 2, video mode controlling apparatus 20 according to the present invention includes video mode checking portion 21, LCD on/off switching portion 22 and video mode changing portion 23.

Video mode checking portion 21 receives mode change controlling information for requesting the change of the video mode and checks whether or not the information is a video mode supported by video controller 25 incorporated in the computer.

LCD on/off switching portion 22 has a function of turning the LCD off by cutting off the video data output by video controller 25, turning the LCD power off, turning the LCD back light power off and then starting up video mode changing portion 23, and a function of turning the LCD on by turning the LCD back light power on under the control of video mode changing portion 23, turning the LCD power on and then supplying video data from video controller 25 to LCD 26. Video mode changing portion 23 changes the font and video mode state of video controller 25 so as to correspond to the mode change controlling information.

Figure 3:
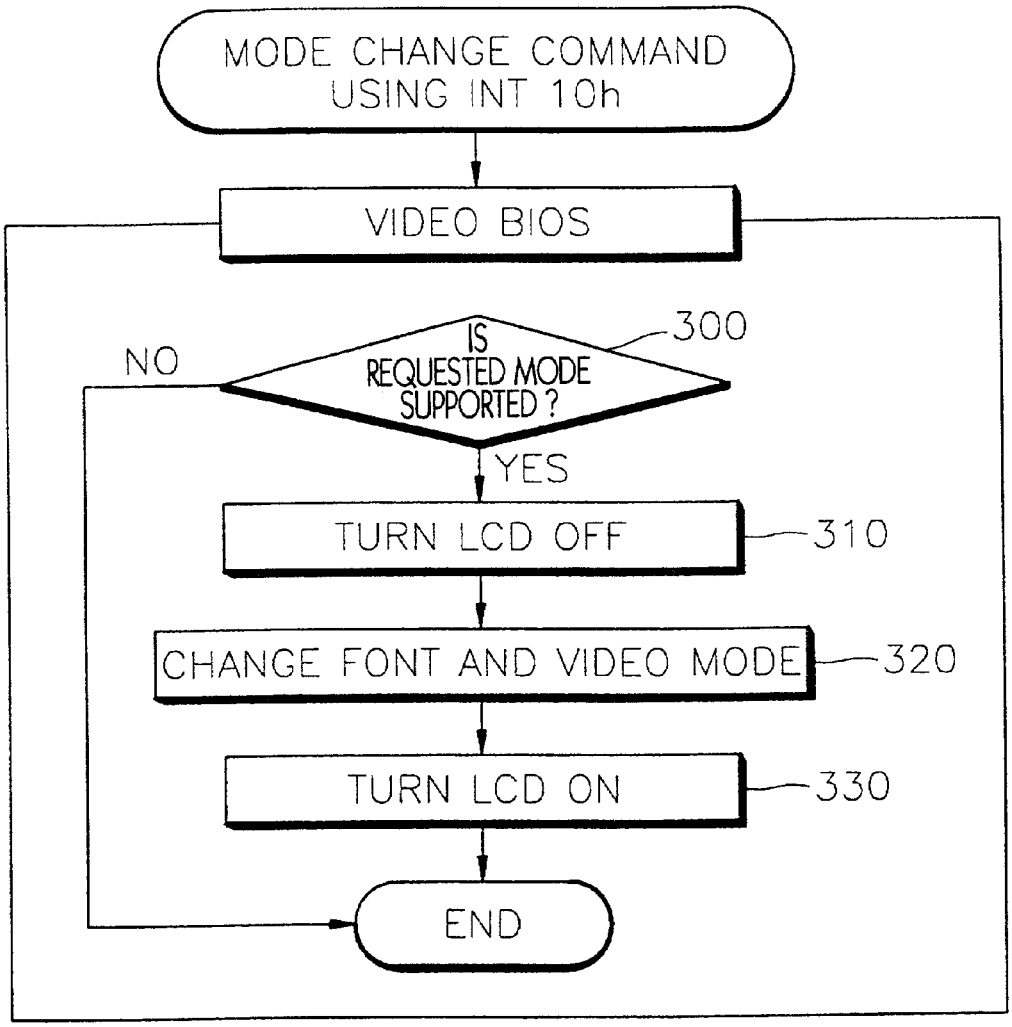
FIG. 3 is a flow chart illustrating a video mode controlling procedure according to the present invention.

Referring to FIG. 3, the video mode changing procedure of a computer having a LCD according to the present invention will now be described. In order to display output data on a LCD by a video mode different from the current video mode by a software operating on a computer system having a LCD, a software video interrupt service routine (Int 10 h) is utilized. The Video BIOS box around the flowchart indicates that the method shown is a function of the Video BIOS. Thus, first, it is checked whether a to-be-changed, that is, requested, video mode included when the Int 10 h is called is supported by a video controller (step 300). In other words, if the to-be-changed video mode is not supported by the video controller, the video mode changing operation is terminated, and if the to-be-changed video mode is supported by the video controller, the LCD is turned off (step 310).

In a state where the LCD is turned off, the font and video mode state of the video controller are changed so as to correspond to the to-be-changed video mode (step 320). If the video mode changing operation is completed, the LCD is turned on to display the output data stored in the video memory on the LCD so as to be suitable to the changed video mode (step 330).

The preferred embodiment of the video mode changing procedure of the computer having a LCD shown in FIG. 3 can be implemented by a program which can be executed by a computer system. Also, functional code means for implementing the present invention can be easily inferred by programmers skilled in the art.

Although it has been described that the present invention was implemented in a video BIOS ROM in a software manner through a specific embodiment of the present invention, the same spirit of the invention can be implemented in a hardware manner by a separate circuit. (The BIOS is stored initially in ROM, but is stored in RAM at execution time for faster execution.) According to the present invention, it is possible to prevent the generation of a whitening phenomenon of a LCD which is liable to occur when the video mode is changed in a computer having the LCD.

What is claimed is:

1. A video mode-changing apparatus of a computer with a liquid crystal display, comprising:

a video mode checker connected to the microprocessor and the video controller of the computer, for receiving a video mode change request and for checking if the requested video mode is supported by the video controller;

a video mode changer for changing the font and video mode state of the video controller to the requested video mode; and a liquid crystal display on/off portion, connected to the video mode checker, the video controller, and the video mode changer, for turning off the liquid crystal display, starting the video mode changer after the liquid crystal display is turned off and turning on the liquid crystal display when the video mode checker determines that the requested video mode is supported by the video controller.

2. The apparatus of claim 1, further comprising:

a connection between said liquid crystal display on/off portion and the liquid crystal display for turning on and off the liquid crystal display.

3. The apparatus of claim 2, further comprising:

means in the liquid crystal display on/off portion for turning on and off the liquid crystal display back light power.

4. A method of changing video modes in a computer with a liquid crystal display, comprising the steps of:

checking whether a requested video mode is supported by the video controller of the computer;

turning off the liquid crystal display of the computer when the requested video mode is found to be supported by the video controller of the computer;

changing the video mode of the video controller to the requested video mode after turning off the liquid crystal display of the computer; and turning on the liquid crystal display.

5. The method of claim 4, said checking step further comprising the step of:

if it is determined that the requested video mode is not supported by the video controller, then terminating the video mode changing operation.

6. The method of claim 4, said step of turning off the liquid crystal display further comprising the steps of:

turning off the liquid crystal display by cutting off the video data output of the video controller;

turning off the liquid crystal display power; and turning off the LCD back light power.

7. The method of claim 4, said step of turning on the liquid crystal display further comprising the steps of:

turning on the liquid crystal display back light power under the control of the video mode changing portion;

turning on the liquid crystal display power; and supplying video data from the video controller to the liquid crystal display.

8. The method of claim 4, said checking step being performed when a software interrupt service routine is used.

9. The method of claim 8, said software interrupt service routine being the Interrupt 10 h of a Basic Input/Output System.

10. A personal computer, comprising:

a memory for storing programs including an operating system, application programs, and a Basic Input/Output System;

a liquid crystal display;

a video controller for controlling the liquid crystal display; and a microprocessor for executing programs;

said Basic Input/Output System comprising:

code means for checking whether a requested video mode is supported by the video controller of the computer;

code means for turning off the liquid crystal display of the computer when the requested video mode is found to be supported by the video controller of the computer;

code means for changing a video mode of the video controller to the requested video mode after the liquid crystal display of the computer is turned off; and code means for turning on the liquid crystal display.

11. The computer of claim 10, said code means for checking further comprising use of Interrupt 10 h of the Basic Input/Output System.

12. The computer of claim 10, said code means for turning off the liquid crystal display further comprising:

code means for turning off the liquid crystal display by cutting off the video data output of the video controller;

code means for turning off the liquid crystal display power; and code means for turning off the LCD back light power.

13. The computer of claim 10, said code means for turning on the liquid crystal display further comprising:

code means for turning on the liquid crystal display back light power under the control of the video mode changing portion;

code means for turning on the liquid crystal display power; and code means for supplying video data from the video controller to the liquid crystal display.

14. The apparatus of claim 1, said liquid crystal display on/off portion performing said turning off of the liquid crystal display, said starting of the video mode changer, and said turning on of the liquid crystal display not in response to a switching of a mechanical switch.

15. The method of claim 4, said turning off, said changing of the video mode, and said turning on being preformed not in response to a switching of a mechanical switch.

16. The apparatus of claim 10, said turning off of the liquid crystal display, said changing the video mode, and said turning on of the liquid crystal display being not in response to a switching of a mechanical switch.

* * * * *